US009758336B2

(12) United States Patent
Kurokawa et al.

(10) Patent No.: US 9,758,336 B2
(45) Date of Patent: Sep. 12, 2017

(54) SHEET CONVEYING APPARATUS

(71) Applicant: Brother Kogyo Kabushiki Kaisha, Nagoya-shi, Aichi-ken (JP)

(72) Inventors: Kotaro Kurokawa, Gifu (JP); Masahiko Ohta, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/052,656

(22) Filed: Feb. 24, 2016

(65) Prior Publication Data

US 2016/0244289 A1 Aug. 25, 2016

(30) Foreign Application Priority Data

Feb. 25, 2015 (JP) ..... 2015-034676

(51) Int. Cl.

| | |
|---|---|
| ***B65H 31/36*** | (2006.01) |
| ***B65H 31/26*** | (2006.01) |
| ***B65H 31/02*** | (2006.01) |
| ***B65H 29/52*** | (2006.01) |
| ***B65H 29/70*** | (2006.01) |

(52) U.S. Cl.

CPC ..... *B65H 31/26* (2013.01); *B65H 29/52* (2013.01); *B65H 29/70* (2013.01); *B65H 31/02* (2013.01); *B65H 2301/4212* (2013.01); *B65H 2301/51214* (2013.01); *B65H 2402/545* (2013.01); *B65H 2404/63* (2013.01); *B65H 2405/115* (2013.01); *B65H 2405/3321* (2013.01); *B65H 2601/111* (2013.01); *B65H 2801/06* (2013.01); *B65H 2801/39* (2013.01)

(58) Field of Classification Search

CPC .... B65H 2301/4223; B65H 2301/4222; B65H 31/00; B65H 31/20; B65H 31/26; B65H 31/34; B65H 31/36; B65H 31/38; B65H 2405/11425; B65H 2405/1144; B65H 2511/10; B65H 2405/112

See application file for complete search history.

(56) References Cited

U.S. PATENT DOCUMENTS

| | | | | |
|---|---|---|---|---|
| 8,459,639 | B2 | 6/2013 | Nagao | |
| 9,162,840 | B1 * | 10/2015 | Ohta | B65H 29/22 |
| 2009/0324263 | A1 * | 12/2009 | Shimizu | B65H 1/04 399/38 |

(Continued)

FOREIGN PATENT DOCUMENTS

JP 2012-158427 A 8/2012

*Primary Examiner* — Thomas Morrison

(74) *Attorney, Agent, or Firm* — Banner & Witcoff, Ltd.

(57) ABSTRACT

A sheet conveying apparatus includes: a conveyor configured to convey a sheet along a conveyance path; a discharge tray configured to support the sheet discharged from the conveyance path; a sheet presser movable toward and away from a support surface of the discharge tray and configured to press the sheet being discharged, onto the support surface; a first stopper configured to limit a spaced distance between the sheet presser and the support surface to a first distance when the first stopper is located at a first position, and configured to allow the spaced distance to become greater than the first distance when the first stopper is located at a second position; and a position change mechanism configured to change a position of the first stopper between the first position and the second position.

14 Claims, 9 Drawing Sheets

(56) References Cited

U.S. PATENT DOCUMENTS

| | | | | |
|---|---|---|---|---|
| 2011/0198801 | A1* | 8/2011 | Yamaguchi | B65H 31/02<br>271/207 |
| 2012/0070212 | A1* | 3/2012 | Ishida | B65H 31/26<br>399/365 |
| 2012/0193867 | A1 | 8/2012 | Nagao | |

* cited by examiner

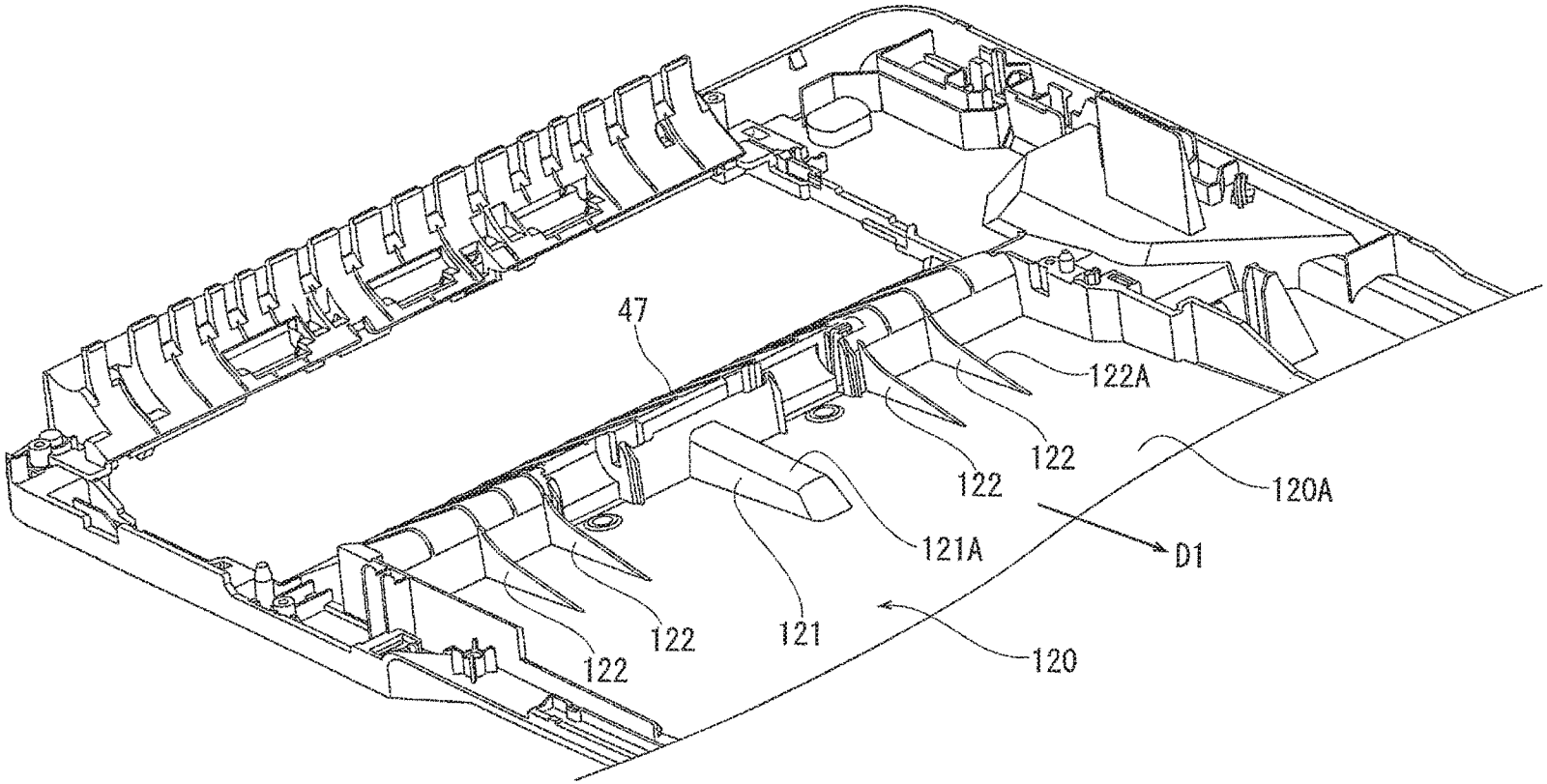
FIG.6
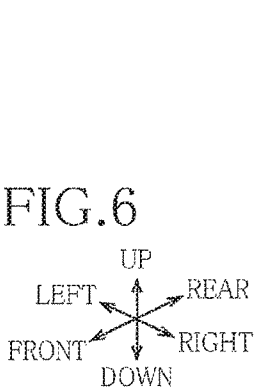

SHEET CONVEYING APPARATUS

CROSS REFERENCE TO RELATED APPLICATION

The present application claims priority from Japanese Patent Application No. 2015-034676, which was filed on Feb. 25, 2015, the disclosure of which is herein incorporated by reference in its entirety.

BACKGROUND

Technical Field

The following disclosure relates to a sheet conveying apparatus.

Description of the Related Art

There is known a sheet conveying apparatus including a conveyor for conveying a sheet along a conveyance path. The conveyor includes a discharge device for discharging the sheet from the conveyance path onto a discharge tray.

The discharge tray has a support surface for supporting a lower surface of the sheet. The discharge device includes a sheet presser which is movable toward and away from the support surface. The sheet presser is urged by a torsion coil spring so as to move toward the support surface. With this construction, the sheet presser presses the sheet being discharged, onto the support surface.

SUMMARY

In the conventional sheet conveying apparatus, a substantially plate member defining the conveyance path is disposed over the support surface, and the sheet presser is pivotably supported by the substantially plate member. It is possible to consider that the sheet presser is moved away from the support surface against an urging force of the torsion coil spring and stopped by contacting the substantially plate member, and this position of the stop of the sheet presser is a limit position to which the sheet presser is movable away from the support surface of the discharge tray. That is, the limit position is fixed in this sheet conveying apparatus.

Here, in the case where the sheet being discharged by the discharge device is jammed near the sheet presser, a user moves the sheet presser to the limit position and places his or her hand into a space between the sheet presser and the support surface to remove the jammed sheet. If the space between the sheet presser and the support surface is small, it is difficult for the user to place his or her hand into the space, resulting in increased difficulty of removing the jammed sheet.

Accordingly, an aspect of the disclosure relates to a sheet conveying apparatus including a sheet presser that reliably presses a sheet being discharged, onto a support surface, and allowing a user to remove a sheet jammed near the sheet presser.

In one aspect of the disclosure, a sheet conveying apparatus includes: a conveyor configured to convey a sheet along a conveyance path; a discharge tray configured to support the sheet discharged from the conveyance path; a sheet presser movable toward and away from a support surface of the discharge tray and configured to press the sheet being discharged, onto the support surface; a first stopper configured to limit a spaced distance between the sheet presser and the support surface to a first distance when the first stopper is located at a first position, and configured to allow the spaced distance to become greater than the first distance when the first stopper is located at a second position; and a position change mechanism configured to change a position of the first stopper between the first position and the second position.

In another aspect of the disclosure, a sheet conveying apparatus includes: a conveyor configured to convey a sheet along a conveyance path; a discharge tray configured to support the sheet discharged from the conveyance path; a sheet presser movable toward and away from a support surface of the discharge tray and configured to press the sheet being discharged, onto the support surface; and a switcher configured to switch a state of the sheet conveying apparatus between a first state in which the conveyor conveys the sheet and a second state different from the first state. A spaced distance between the sheet presser and the support surface is limited to a first distance when the sheet conveying apparatus is in the first state. The spaced distance is limited to a second distance greater than the first distance when the sheet conveying apparatus is in the second state.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which:

FIG. 6 is a partial perspective view principally illustrating a support surface of the discharge tray, a protrusion, and second ribs;

DETAILED DESCRIPTION OF THE EMBODIMENTS

Hereinafter, there will be described one embodiment by reference to the drawings.

Embodiment

Figure 1:
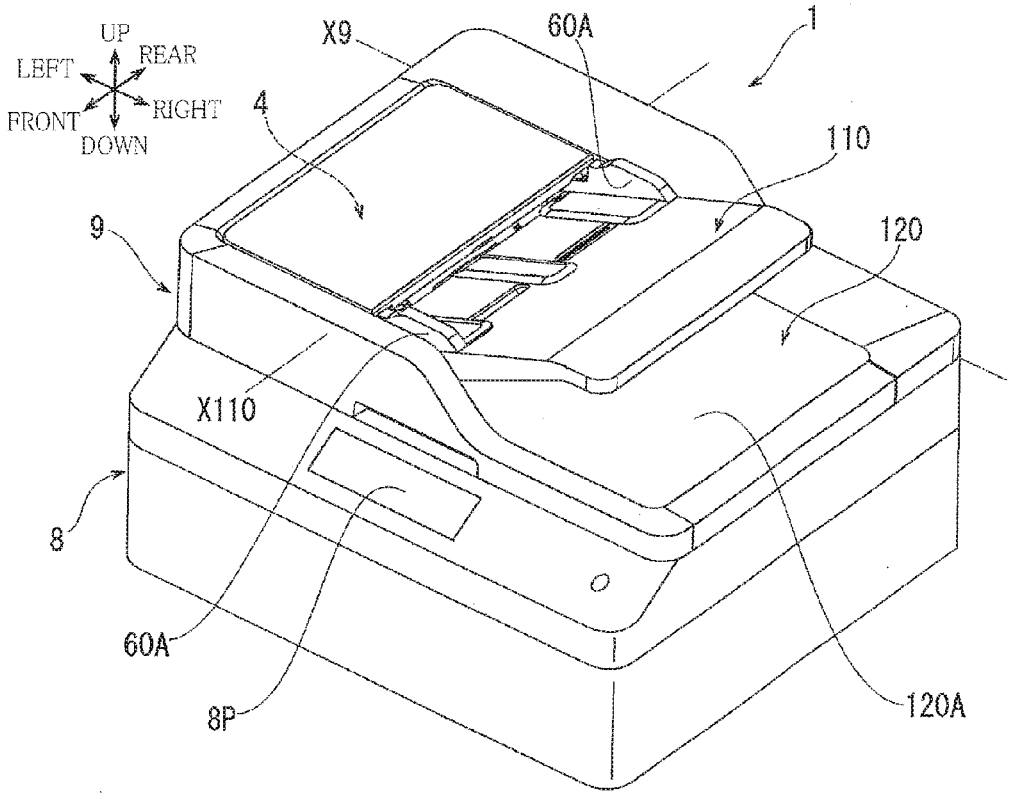
FIG. 1 is a perspective view of an image reading apparatus according to one embodiment.

FIG. 1 illustrates an image reading apparatus 1 according to one embodiment as one example of a sheet conveying apparatus. In FIG. 1, a side of an image reading apparatus 1 on which an operation panel 8P is provided is defined as a front side, and the other sides and front, rear, left, right, up, and down directions are defined assuming the image reading apparatus 1 is viewed from the front side.

Overall Construction

Figure 2:
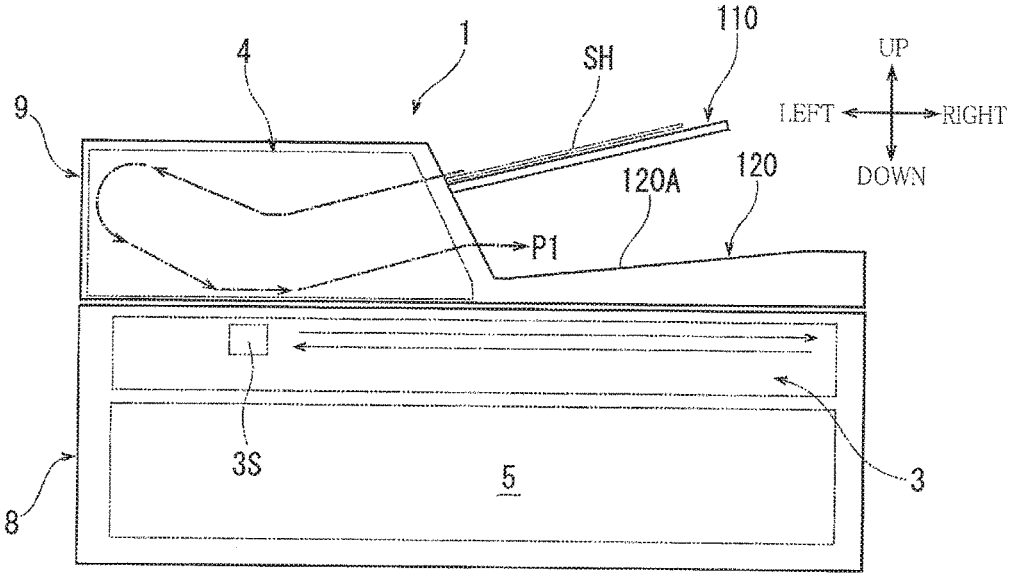
FIG. 2 is a schematic front elevational view of the image reading apparatus.
Figure 3:
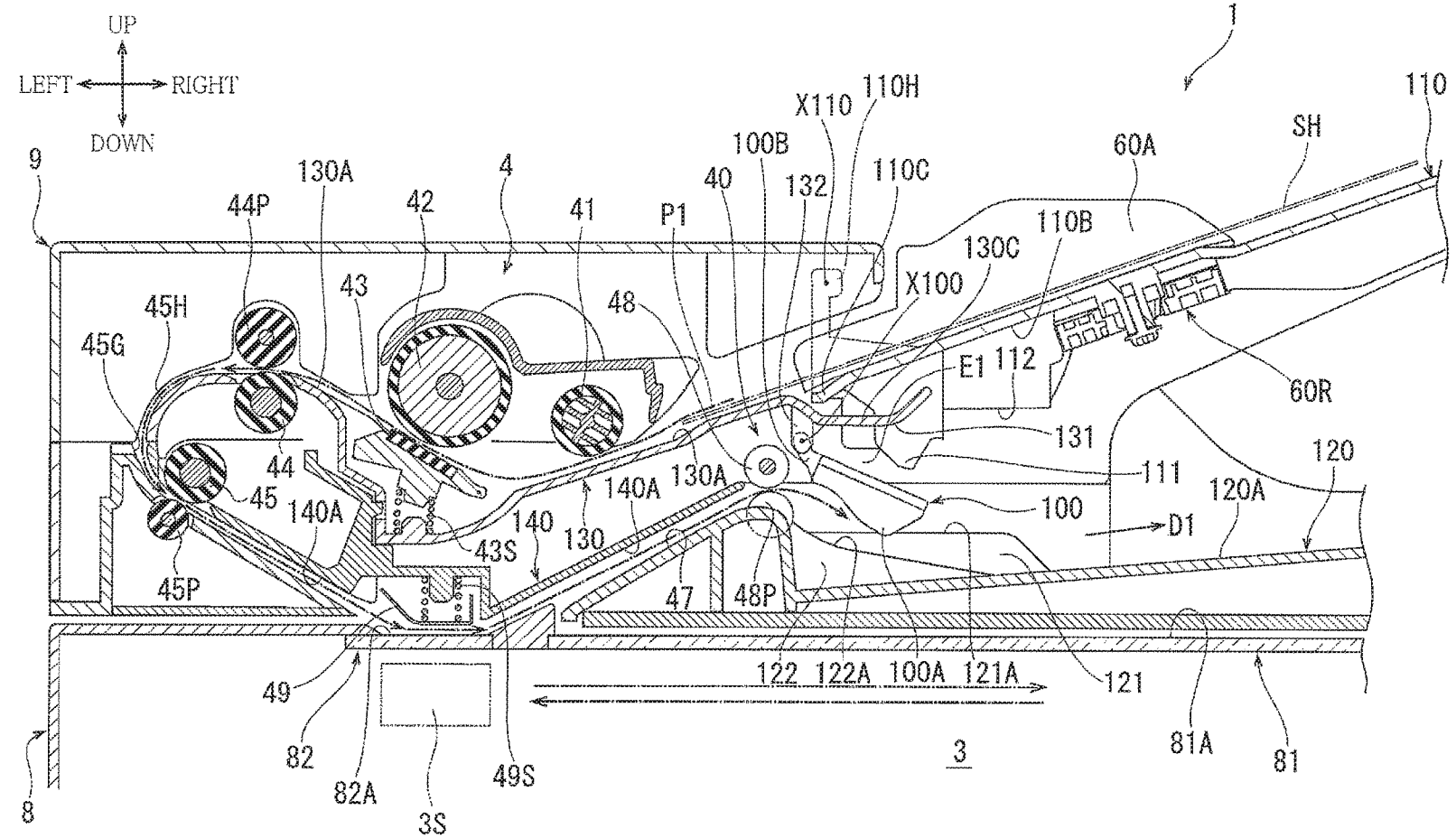
FIG. 3 is a schematic partial cross-sectional view of the image reading apparatus.

As illustrated in FIGS. 1-3, the image reading apparatus 1 includes a main body 8, an opening and closing member 9, an image forming unit 5, a reading unit 3, and a conveyor 4. The main body 8 is shaped like a flat box. As illustrated in FIG. 1, a front surface of the main body 8 is provided with the operation panel 8P in the form of a touch screen, for example.

As illustrated in FIG. 2, the image forming unit 5 is provided in a lower portion of the main body 8. The image forming unit 5 performs ink-jet or laser recording to form an image on a sheet SH. As illustrated in FIGS. 2 and 3, the reading unit 3 is provided in an upper portion of the main body 8. The reading unit 3 reads an image formed on a document. The conveyor 4 is provided on the opening and closing member 9. The conveyor 4 conveys each sheet SH from a supply tray 110 along a conveyance path P1. The reading unit 3 reads an image formed on the conveyed sheet SH.

As illustrated in FIG. 3, a first platen glass 81 and a second platen glass 82 are provided on an upper surface of the main body 8. An upper surface of the first platen glass 81 serves as a document support surface 81A. When the reading unit 3 reads an image formed on a stationary document, the document support surface 81A supports a lower surface of the document. Examples of the document include sheets, such as paper sheets and OHP sheets, and books.

The second platen glass 82 is located at the left of the first platen glass 81 and elongated in the front and rear direction. An upper surface of the second platen glass 82 serves as a reading surface 82A. When the reading unit 3 reads the sheets SH conveyed one by one by the conveyor 4, the reading surface 82A supports and guides lower surfaces the respective sheets SH. In the present embodiment, an object for which image reading is performed using the document support surface 81A is referred to as "document", and an object for which image reading is performed using the conveyor 4 is referred to as "sheet SH". The document and the sheet SH may be substantially the same as each other.

As illustrated in FIG. 1, the opening and closing member 9 is supported by hinges, not illustrated, provided on an upper edge of a rear surface of the main body 8. The opening and closing member 9 is pivotable about an opening and closing axis X9 extending in the right and left direction. In a closed state illustrated in FIGS. 1-3, the opening and closing member 9 covers the document support surface 81A facing upward. Though not illustrated, the opening and closing member 9 is pivotable about the opening and closing axis X9 such that a front end portion of the opening and closing member 9 is moved upward and rearward. When this pivotal movement is caused, a position of the opening and closing member 9 is changed to an open position, so that the document support surface 81A is exposed. This state allows a user to place a document to be read, onto the document support surface 81A.

As illustrated in FIG. 3, the reading unit 3 includes: a reading sensor 3S provided in the upper portion of the main body 8; and a scanning mechanism, not illustrated. The scanning mechanism reciprocates the reading sensor 3S in the right and left direction in the main body 8 under the document support surface 81A and the reading surface 82A. When the reading sensor 3S reads an image formed on the document placed on the document support surface 81A, the reading sensor 3S reads the image while being moved under the document support surface 81A. The reading sensor 3S is stopped under the reading surface 82A at a particular stationary reading position. When the reading sensor 3S reads an image formed on the sheet SH conveyed by the conveyor 4, the reading sensor 3S is stopped at the stationary reading position. The reading sensor 3S is a well-known image reading sensor such as a contact image sensor (CIS) and a charge coupled device (CCD).

As illustrated in FIGS. 1-6, the conveyor 4 includes the supply tray 110 and a discharge tray 120.

The supply tray 110 is provided at a right portion of the opening and closing member 9. The supply tray 110 supports a lower surface of the sheet SH or a lowermost one of the sheets SH to be conveyed by the conveyor 4 for image reading. An upper surface of the supply tray 110 is a flat surface inclined so as to be lower at its left portion than at its right portion.

As illustrated in FIGS. 1 and 2, the supply tray 110 is provided with two guides 60A each slidable in the front and rear direction. The guides 60A are opposed to each other in the front and rear direction and coupled to each other by a rack-and-pinion mechanism 60R illustrated in FIGS. 3 and 5. The front guide 60A and the rear guide 60A are movable toward and away from each other. This construction allows the guides 60A to hold front and rear edges of the sheets SH of various sizes which are placed on the supply tray 110.

As illustrated in FIGS. 1-6, the discharge tray 120 is located under the supply tray 110. An upper surface of the discharge tray 120 serves as a support surface 120A for supporting a lower surface of the sheet SH. When image reading is performed for a plurality of the sheets SH by the reading sensor 3S, and the sheets SH are discharged onto the support surface 120A by the conveyor 4, the sheets SH are stacked on the support surface 120A. The support surface 120A is a flat surface inclined so as to be higher at its right portion than at its left portion.

Figure 7:
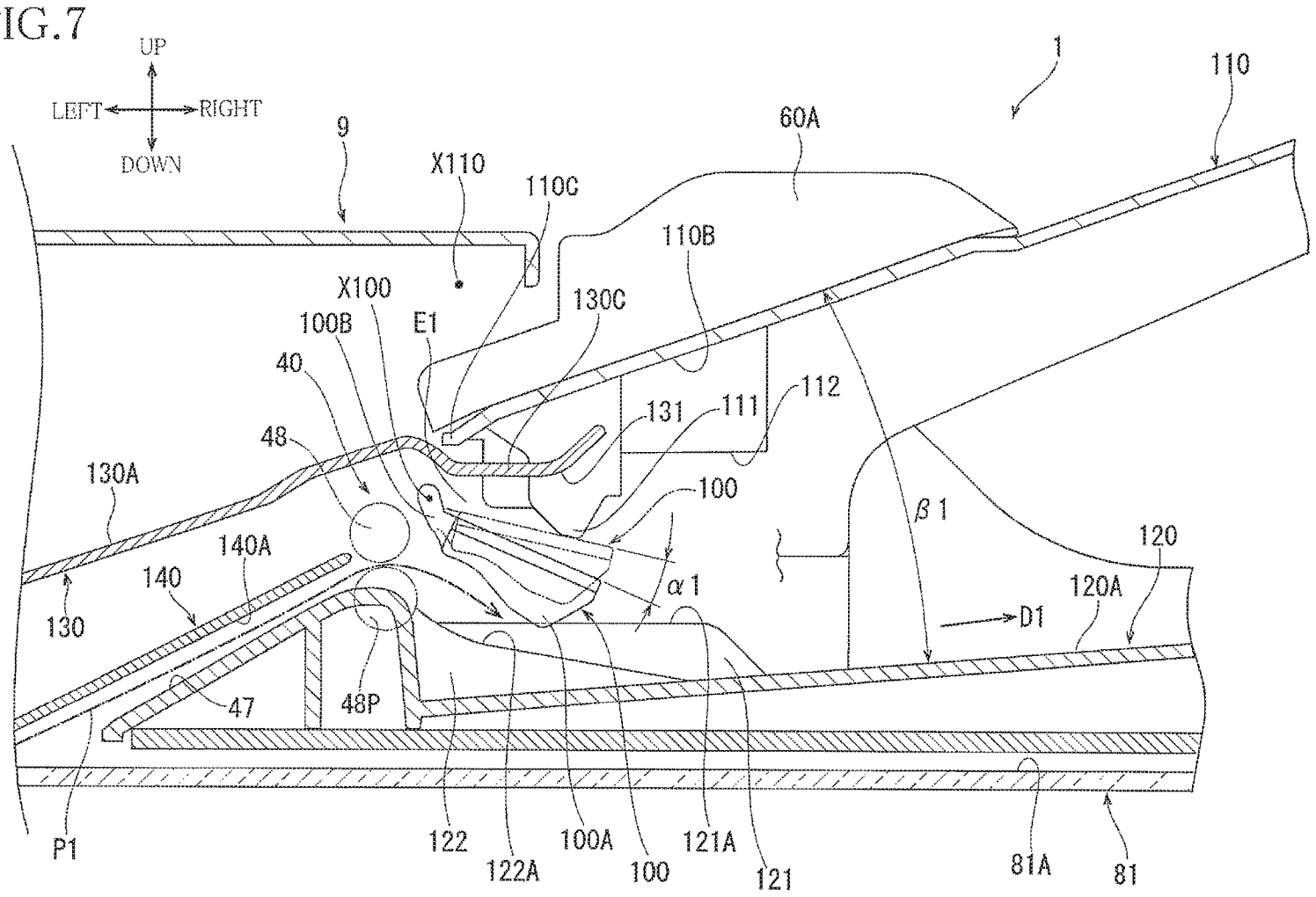
FIG. 7 is a schematic partial cross-sectional view for explaining operations of components such as sheet pressers, a first stopper, and a second stopper.

As illustrated in FIGS. 3-5, 7, and 8, for example, the supply tray 110 is supported by the opening and closing member 9 so as to be pivotable about a pivot axis X110. As illustrated in FIGS. 1 and 7, for example, the pivot axis X110 extends in the front and rear direction above a left end portion 110C of the supply tray 110. Two hinges 110H, each simply indicated by the two-dot chain lines in FIG. 3, are provided respectively on front and rear corner portions of the left end portion 110C of the supply tray 110. These hinges 110 H extend to the pivot axis X110. The hinges 110H are supported by the opening and closing member 9, enabling the supply tray 110 to pivot about the pivot axis X110. The supply tray 110 is one example of a position change mechanism, a switcher, and a movable tray.

Figure 4:
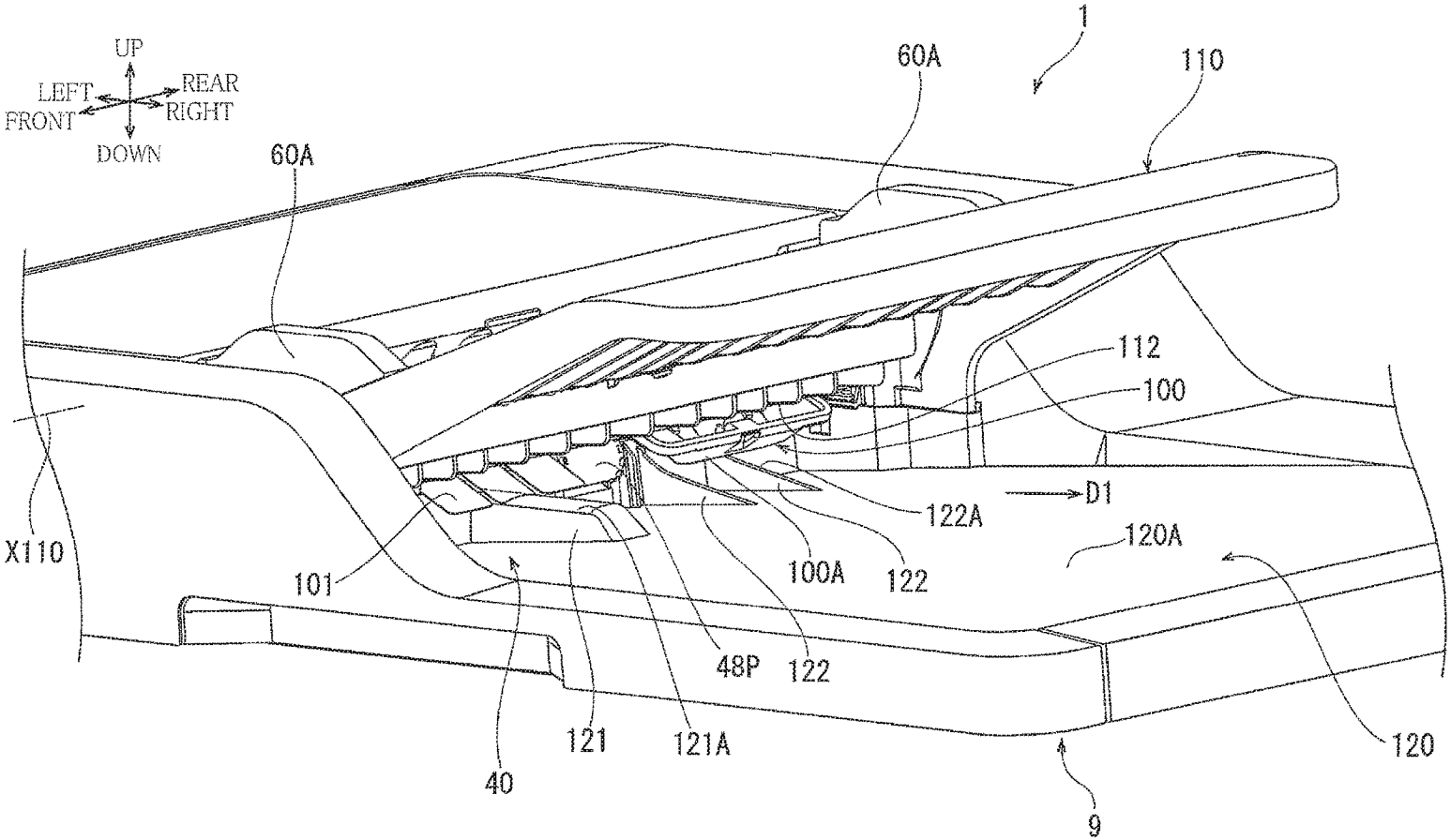
FIG. 4 is a partial perspective view principally illustrating a supply tray, a discharge device, and a discharge tray.
Figure 5:
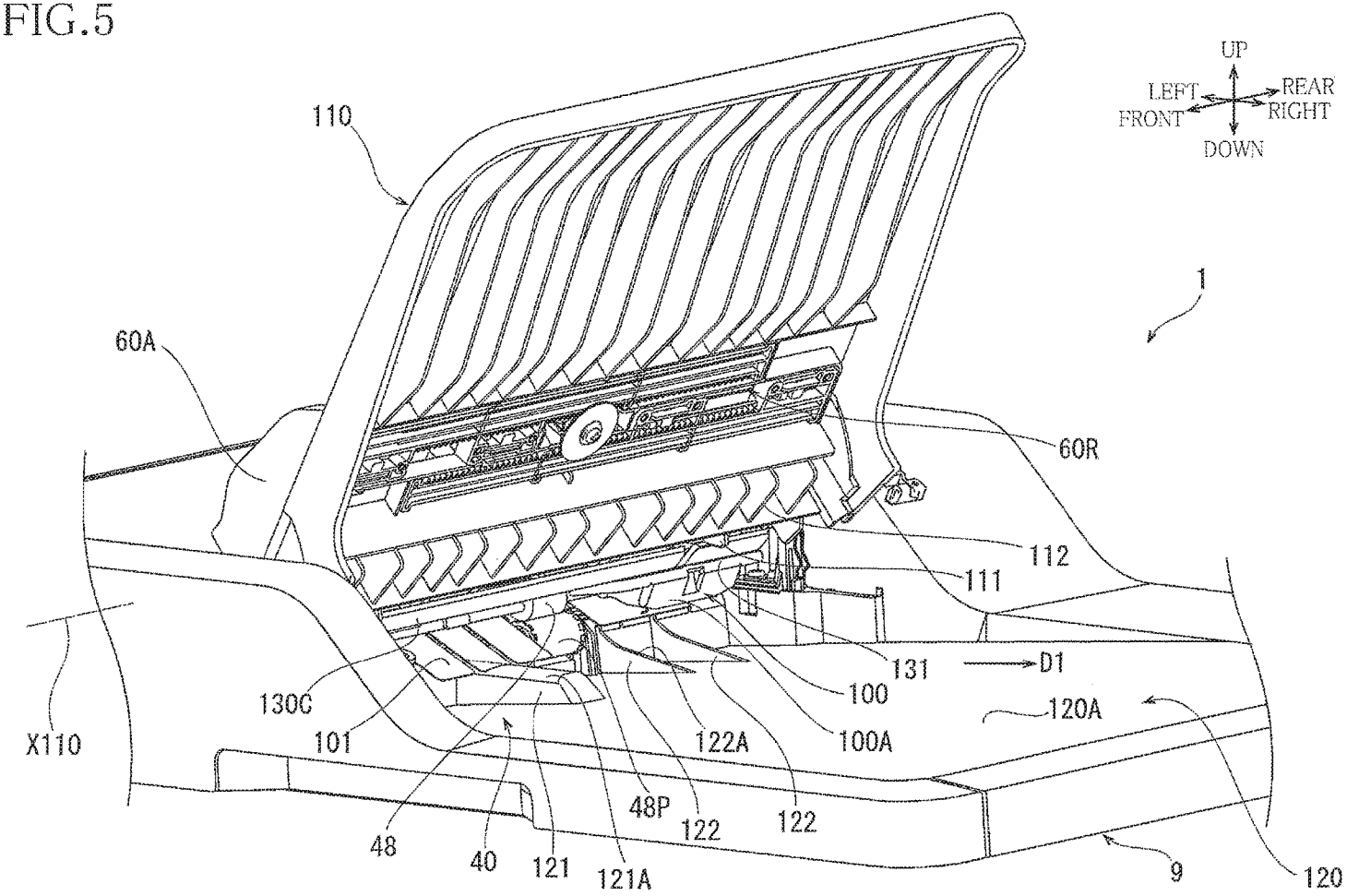
FIG. 5 is a partial perspective view principally illustrating the supply tray, the discharge device, and the discharge tray.
Figure 8:
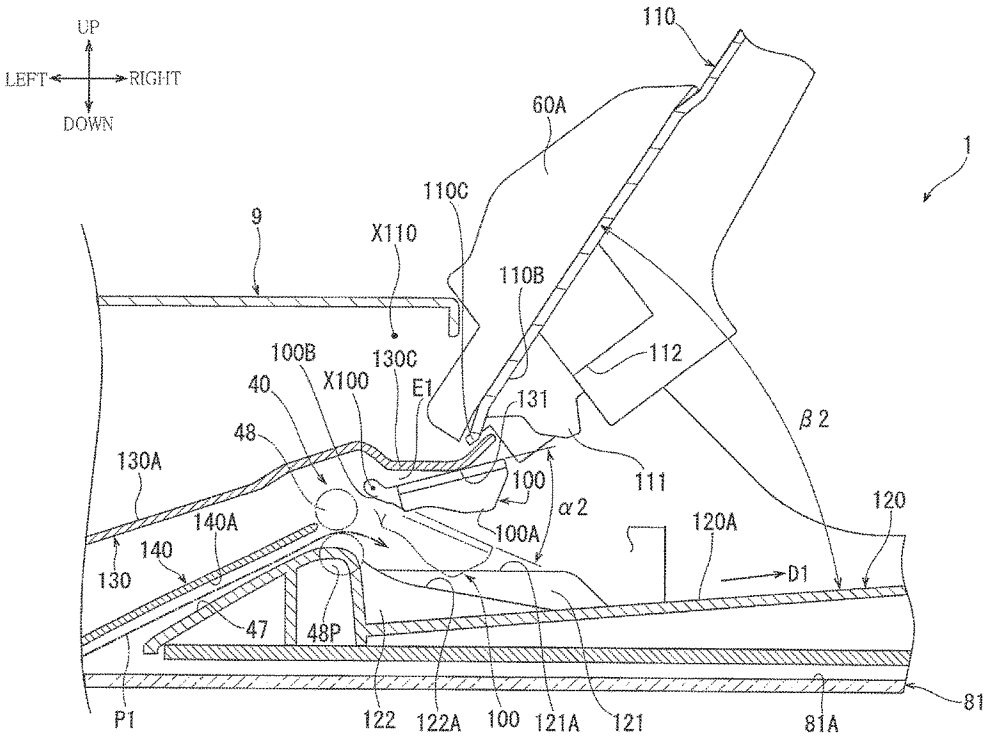
FIG. 8 is a schematic partial cross-sectional view for explaining operations of the components such as the sheet pressers, the first stopper, and the second stopper.

As illustrated in FIGS. 1, 4, and 7, the sheet SH to be conveyed by the conveyor 4 is supportable by the supply tray 110. This position of the supply tray 110 will be referred to as "third position", and this state of the image reading apparatus 1 will be referred to as "first state". As illustrated in FIGS. 5 and 8, on the other hand, when pivotal movement of the supply tray 110 is caused about the pivot axis X110, the supply tray 110 is positioned farther from the support surface 120A than the third position. This position of the supply tray 110 will be referred to as "fourth position", and this state of the image reading apparatus 1 will be referred to as "second state".

β1 in FIG. 7 denotes an angle between the support surface 120A of the discharge tray 120 and the sheet-support surface, i.e., the upper surface of the supply tray 110, in the state in which the supply tray 110 is located at the third position (the first state). β2 in FIG. 8 denotes an angle between the support surface 120A of the discharge tray 120 and the sheet-support surface of the supply tray 110, in the state in which the supply tray 110 is located at the fourth position after its pivotal movement from the third position (the second state). The angle β2 is greater than the angle β1.

As illustrated in FIG. 3, the conveyor 4 includes an upper chute 130 and a lower chute 140. The upper chute 130 is one example of a chute. The upper chute 130 and the lower chute 140 are assembled to components such as the discharge tray 120 and side walls of the opening and closing member 9. The lower chute 140 is provided under the upper chute 130.

An upper surface of the upper chute 130 serves as an upper conveying surface 130A. The upper conveying surface 130A is a substantially flat surface which is inclined downward and then upward in the left direction from a position near the supply tray 110. A lower surface of the lower chute 140 serves as a lower conveying surface 140A. The lower conveying surface 140A is a substantially flat surface which is inclined downward in the right direction from a position near a left end of the opening and closing member 9 toward the reading surface 82A and then inclined upward in the right direction.

In the opening and closing member 9, the conveyor 4 has the conveyance path P1 defined by (i) guide surfaces such as the upper conveying surface 130A of the upper chute 130 and the lower conveying surface 140A of the lower chute 140, (ii) guide surfaces and guide ribs formed on inner surfaces of various kinds of covers of the opening and closing member 9, and (iii) conveying rollers, for example. The conveyance path P1 first extends leftward from the supply tray 110 along the upper conveying surface 130A of the upper chute 130. The conveyance path P1 is then curved downward, then inclined downward toward the reading surface 82A, and then extends rightward along the reading surface 82A for a short distance. The conveyance path P1 is finally inclined upward in the right direction from a right end of the reading surface 82A to the discharge tray 120.

A conveying direction in which the sheet SH is conveyed by the conveyor 4 is the left direction in the upper portion of the conveyance path P1. The conveying direction changes from the left direction to the right direction in the downward curved portion of the conveyance path P1. The conveying direction is the right direction in the portion of the conveyance path P1 which extends through the reading surface 82A to the discharge tray 120. It is noted that the shape of the conveyance path P1 and the direction in which the conveyance path P1 extends are one example.

The conveyor 4 includes a supply roller 41, a separating roller 42, and a separating pad 3 at a portion of the upper portion of the conveyance path P1 near the supply tray 110.

The supply roller 41 and the separating roller 42 are provided over and opposite to the upper conveying surface 130A of the upper chute 130. The separator pad 43 is provided under and opposite to the separating roller 42 and interposed between the separating roller 42 and the upper chute 130. The separator pad 43 is shaped like a plate formed of a soft material such as rubber and elastomer. The separator pad 43 is pressed onto the separating roller 42 by an urging spring 43S.

The supply roller 41 and the separating roller 42 are rotated in accordance with each other. The supply roller 41 supplies one or more of the sheets SH from the supply tray 110 toward the separating roller 42. The separating roller 42 is rotated in contact with the sheet SH supplied from the supply tray 110 to the conveyance path P1, so that the sheet SH is conveyed to a downstream side in the conveying direction. In the case where two or more sheets SH are supplied to the separating roller 42 by the supply roller 41, the separator pad 43 cooperates with the separating roller 42 to separate an uppermost one of the sheets SH from the other sheets SH.

At the upper portion of the conveyance path P1, the conveyor 4 includes a conveying roller 44 and a pinch roller 44P provided at the left of the separating roller 42. That is, the conveying roller 44 and the pinch roller 44P are located downstream of the separating roller 42 in the conveying direction. The conveying roller 44 and the pinch roller 44P nip the sheet SH separated by the separating roller 42 and the separator pad 43 and convey the sheet SH to a downstream side in the conveying direction.

At the downward curved portion of the conveyance path P1, the conveyor 4 includes a curved guide surface 45G, a curved guide surface 45H, a conveying roller 45, and a pinch roller 45P. The curved guide surface 45G and the curved guide surface 45H face each other at a particular distance therebetween. The curved guide surface 45G defines the downward curved portion of the conveyance path P1 from an outer side thereof. The curved guide surface 45H defines the downward curved portion of the conveyance path P1 from an inner side thereof. The conveying roller 45 and the pinch roller 45P nip the sheet SH conveyed by the conveying roller 44 and the pinch roller 44P and convey the sheet SH toward the reading surface 82A.

The conveyor 4 includes a pressing member 49 provided over and opposite to the reading surface 82A. A compression coil spring 49S is provided between the lower chute 140 and the pressing member 49. An urging force of the compression coil spring 49S causes the pressing member 49 to press an upper surface of the sheet SH conveyed from the conveying roller 45, to bring the sheet SH into pressing contact with the reading surface 82A.

The conveyor 4 includes a guide wall 47 at the right of the pressing member 49. The guide wall 47 is located under the lower conveying surface 140A of the lower chute 140 so as to form a space between the guide wall 47 and the lower conveying surface 140A. The guide wall 47 defines a bottom of the upward inclined portion of the conveyance path P1 which is located at the right of the pressing member 49.

Discharge Device

The image reading apparatus 1 includes a discharge device 40 that partly constitutes the conveyor 4. The discharge device 40 discharges the sheet SH from the conveyance path P1 onto the discharge tray 120. D1 in FIG. 3 denotes a discharge direction in which the sheet SH is discharged onto the discharge tray 120. In the present embodiment, the discharge direction D1 is directed rightward and inclined slightly upward along the support surface 120A of the discharge tray 120. In the present embodiment, a widthwise direction of the sheet SH which is perpendicular to the discharge direction D1 coincides with the front and rear direction.

Specifically, as illustrated in FIGS. 3-9, the discharge device 40 includes discharge rollers 48, pinch rollers 48P, sheet pressers 100, a first stopper 111, a second stopper 131, and first ribs 112.

Figure 9:
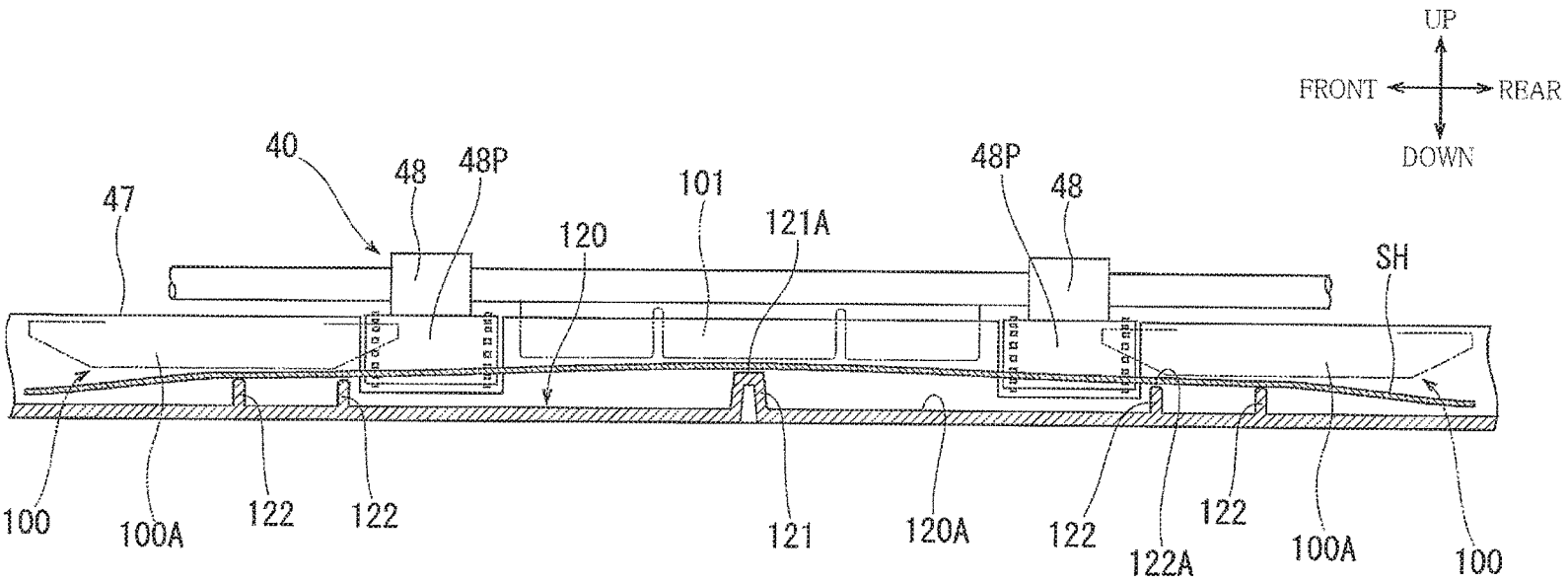
FIG. 9 is a schematic view for explaining operations of the sheet pressers, the protrusion, and the second ribs for a sheet discharged by a discharge device.

As illustrated in, e.g., FIG. 3, the discharge rollers 48 and the pinch rollers 48P are provided at the upward inclined portion of the conveyance path P1 which is located at the right of the pressing member 49. The discharge rollers 48 and the pinch rollers 48P are located upstream of the discharge tray 120 in the conveying direction. As illustrated in FIG. 9, front and rear pairs of the discharge rollers 48 and the pinch rollers 48P are provided.

As illustrated in, e.g., FIG. 3, the discharge rollers 48 are located near a right end of the lower conveying surface 140A of the lower chute 140. The pinch rollers 48P are located near a right end of the guide wall 47. The discharge rollers 48 and the pinch rollers 48P nip the sheet SH conveyed along the reading surface 82A and discharge the sheet SH onto the support surface 120A of the discharge tray 120.

The sheet pressers 100 are provided downstream of the discharge rollers 48 and the pinch rollers 48P in the discharge direction D1. As illustrated in FIG. 9, the sheet pressers 100 are spaced apart from each other in the front and rear direction. The front sheet presser 100 and the rear sheet presser 100 are respectively located on an outer side of the front discharge roller 48 and the rear discharge roller 48 in the front and rear direction. The front and rear sheet pressers 100 are symmetric with respect to a center line of the discharge tray 120 which extends in the conveying direction, and the following description will be provided for only one of the sheet pressers 100.

As illustrated in, e.g., FIGS. 3 and 7, the sheet presser 100 is located between the left end portion 110C of the supply tray 110 and the support surface 120A of the discharge tray 120 in the up and down direction. The upper chute 130 protrudes rightward, with a right end portion 130C thereof being located under the left end portion 110C of the supply tray 110. That is, the right end portion 130C of the upper chute 130 and the left end portion 110C of the supply tray 110 overlap each other when viewed in the up and down direction, and the left end portion 110C of the supply tray 110 is located just above the right end portion 130C of the upper chute 130. The sheet presser 100 is located below the right end portion 130C of the upper chute 130. The right end portion 130C of the upper chute 130 is recessed downward to avoid contact with the left end portion 110C of the supply tray 110 during pivotal movement of the supply tray 110 about the pivot axis X110.

As illustrated in, e.g., FIGS. 4, 7, and 9, the sheet presser 100 is shaped like a substantially flat plate. As illustrated in, e.g., FIG. 7, when viewed in the front and rear direction, the sheet presser 100 has a flat upper surface and a lower surface partly protruding downward. The downward protruding portion of the sheet presser 100 serves as a contact portion 100A. The pivot axis X110 of the supply tray 110 is located upstream of the contact portion 100A in the discharge direction D1.

As illustrated in FIG. 3, the sheet presser 100 has a left end portion serving as a supported portion 100B. The supported portion 100B protrudes upward and rightward. The right end portion 130C of the upper chute 130 is provided with a supporter 132 protruding downward. The supporter 132 protrudes downward from a lower surface of the upper chute 130 at a position near an area in which the right end portion 130C of the upper chute 130 and the left end portion 110C of the supply tray 110 overlap each other when viewed in the up and down direction. The supported portion 100B is supported by the supporter 132, enabling the sheet presser 100 to pivot about a pivot axis X100 extending in the front and rear direction. The sheet presser 100 is mounted such that the contact portion 100A is opposed to the support surface 120A. When pivotal movement of the sheet presser 100 is caused about the pivot axis X100, the contact portion 100A is moved toward and away from the support surface 120A.

A torsion coil spring, not illustrated, is provided between the sheet presser 100 and the supporter 132 of the upper chute 130. The sheet presser 100 is urged by the torsion coil spring, not illustrated, so as to pivot about the pivot axis X100 in the clockwise direction in FIGS. 3, 7, and 8 toward the support surface 120A.

As indicated by the solid line in FIG. 7, the contact portion 100A is located closest to the support surface 120A in a state in which the sheet SH is not discharged onto the support surface 120A. The contact portion 100A is urged by an urging force of the torsion coil spring, not illustrated, so as to press the sheet SH being discharged, onto the support surface 120A of the discharge tray 120. With this construction, the sheet SH being discharged by the discharge rollers 48 and the pinch rollers 48P travels toward the support surface 120A while being pressed by the contact portion 100A of the sheet presser 100.

As illustrated in FIGS. 4, 5, and 9, films 101 are provided between the front sheet presser 100 and the rear sheet presser 100. The films 101 press and hold the sheet SH being discharged by the discharge rollers 48 and the pinch rollers 48P, onto the support surface 120A with the sheet presser 100.

As illustrated in, e.g., FIGS. 5, 7, and 8, the first stopper 111 is provided on the supply tray 110 and partly constitutes the discharge device 40. As illustrated in FIG. 7, the first stopper 111 is provided on a facing surface 110B. The facing surface 110B is a back side of the supply tray 110 from its surface on which the sheet SH is placeable. That is, the facing surface 110B faces the sheet presser 100 located under the facing surface 110B in the state in which the supply tray 110 is located at the third position (the first state). The first stopper 111 is a rib which protrudes downward from the facing surface 110B. In the present embodiment, the first stopper 111 is molded integrally with the supply tray 110 formed of resin.

In the state in which the supply tray 110 is located at the third position (the first state), as indicated by the solid line in FIG. 7, when the sheet presser 100 is urged by the torsion coil spring, not illustrated, so as to be positioned close to the support surface 120A, the first stopper 111 is spaced apart from the sheet presser 100.

When the sheet SH being discharged presses the sheet presser 100 so as to cause pivotal movement thereof in the counterclockwise direction in FIG. 7, the first stopper 111 contacts an upper portion of the sheet presser 100 to prevent the sheet presser 100 from being moved off the sheet SH. This state of the sheet presser 100 is indicated by two-dot chain lines in FIG. 7. The position of the sheet presser 100 in this state is a first limit position. That is, when the sheet presser 100 is limited (restrained) by the first stopper 111, the sheet presser 100 is pivotable within an angle $\alpha 1$ illustrated in FIG. 7, in other words, the sheet presser 100 is pivotable within a range in which a spaced distance between the sheet presser 100 and the support surface 120A is a particular distance as one example of a first distance. The position of the first stopper 111 in FIG. 7 is one example of a first position defining the first limit position of the sheet presser 100. That is, when located at the first position, the first stopper 111 limits the spaced distance between the sheet presser 100 and the support surface 120A, to the particular distance as one example of the first distance.

When the position of the supply tray 110 is changed from the third position illustrated in FIGS. 4 and 7 (the first state) to the fourth position illustrated in FIGS. 5 and 8 (the second state), the first stopper 111 is moved upward and rightward from the first position and spaced apart from the sheet presser 100 such that the first stopper 111 is not contactable with the sheet presser 100. The position of the first stopper 111 in FIGS. 5 and 8 is one example of a second position at which the sheet presser 100 is allowed to be spaced apart from the support surface 120A such that the sheet presser 100 is farther from the support surface 120A at the second position than at the first limit position. That is, when located at the second position, the first stopper 111 allows the spaced distance to exceed the first distance.

As illustrated in FIGS. 3, 7, and 8, the right end portion 130C of the upper chute 130 covers an area El from above. The area El is a portion of the conveyance path P1 in the discharge device 40. The second stopper 131 is a portion of a lower surface of the right end portion 130C of the upper chute 130. The second stopper 131 extends horizontally in the right direction and then is inclined upward in the right direction.

After the position of the supply tray 110 is changed from the third position illustrated in FIGS. 4 and 7 (the first state) to the fourth position illustrated in FIGS. 5 and 8 (the second state), and thereby the position of the first stopper 111 is changed to the second position, when the sheet presser 100 pivots in the counterclockwise direction in FIG. 8, the second stopper 131 contacts the upper portion of the sheet presser 100 to restrain the pivotal movement of the sheet presser 100. This state of the sheet presser 100 is indicated by the solid line in FIG. 8. The position of the sheet presser 100 in this state is one example of a second limit position. That is, when the sheet presser 100 is limited (restrained) by the second stopper 131, the sheet presser 100 is pivotable within an angle $\alpha 2$ illustrated in FIG. 8, in other words, the sheet presser 100 is pivotable within a range in which the spaced distance between the sheet presser 100 and the support surface 120A is a second distance greater than the first distance. The second stopper 131 defines the second limit position at which the sheet presser 100 is spaced apart from the support surface 120A such that the sheet presser 100 is farther from the support surface 120A at the second position than at the first limit position. That is, when located at the second position, the first stopper 111 limits the spaced distance between the sheet presser 100 and the support surface 120A, to the second distance.

As illustrated in, e.g., FIGS. 5, 7, and 8, a plurality of first ribs 112 are formed on the facing surface 110B of the supply tray 110 so as to be spaced apart from each other in the front and rear direction. The first ribs 112 are located downstream of the sheet presser 100 and the first stopper 111 in the discharge direction D1 in the state in which the supply tray 110 is located at the third position illustrated in FIGS. 4 and 7 (the first state). Lower edges of the respective first ribs 112 extend in the discharge direction D1. The lower edges of the first ribs 112 guide the sheet SH being discharged, by contacting the upper surface of the sheet SH.

Protrusion and Second Ribs

As illustrated in FIGS. 3-9, the support surface 120A includes a protrusion 121 and four second ribs 122. The protrusion 121 and the second ribs 122 molded integrally with the discharge tray 120.

As illustrated in, e.g., FIGS. 6, 7, and 9, the protrusion 121 is provided on a central portion of the support surface 120A in the front and rear direction, i.e., the widthwise direction of the sheet SH which is perpendicular to the discharge direction D1. The protrusion 121 is shaped substantially like a prism which protrudes upward from the support surface 120A and extends in the discharge direction D1.

As illustrated in FIG. 9, two of the second ribs 122 are provided in front of the protrusion 121, and the other two of the second ribs 122 are provided at the rear of the protrusion 121. The second ribs 122 are spaced apart from each other in the front and rear direction. The second ribs 122 near the protrusion 121 are provided on an outer side of the discharge rollers 48 and the pinch rollers 48P in the front and rear direction when viewed from the discharge direction D1. Each of the second ribs 122 is shaped substantially like a plate which protrudes upward from the support surface 120A and extends in the discharge direction D1. Upper edges 122A of the respective second ribs 122 are inclined downward so as to be closer to the support surface 120A to a downstream side in the discharge direction D1. The upper edges 122A of the second ribs 122 are curved so as to be recessed downward. An upper edge 121A of the protrusion 121 is located above the upper edges 122A of the respective second ribs 122 and extends to a position located downstream of the second ribs 122 in the discharge direction D1.

Image Reading Operation

In this image reading apparatus 1, when the reading sensor 3S reads an image formed on the document placed on the document support surface 81A, the scanning mechanism, not illustrated, of the reading unit 3 is operated to reciprocate the reading sensor 3S in the right and left direction between the positions under the respective left and right edges of the document support surface 81A. During this reciprocation, the reading sensor 3S reads an image formed on the document placed on the document support surface 81A. After the image reading, the scanning mechanism, not illustrated, moves the reading sensor 3S leftward to its original position in the reading unit 3.

When the reading sensor 3S reads an image formed on the sheet SH supplied from the supply tray 110, the scanning mechanism, not illustrated, is operated to move the reading sensor 3S to the stationary reading position located under the reading surface 82A. When the sheet SH is conveyed from the supply tray 110 by the conveyor 4 along the conveyance path P1, the sheet SH, while contacting the reading surface 82A, passes through the position just above the reading sensor 3S located at the stationary reading position. During this conveyance, the reading sensor 3S reads an image formed on the conveyed sheet. After the image reading, the sheet SH is discharged by the discharge rollers 48 and the pinch rollers 48P onto the discharge tray 120. The discharged sheet SH is supported by the support surface 120A of the discharge tray 120.

In this operation, as illustrated in, e.g., FIGS. 7 and 9, the sheet presser 100 and the films 101 press the sheet SH being discharged, onto the support surface 120A. The protrusion 121, the two second ribs 122 provided in front of the protrusion 121, and the two second ribs 122 provided at the rear of the protrusion 121 raise a central portion of the discharged sheet SH, so that the sheet SH is kept curved. Thus, even in the case where a plurality of the sheets SH are discharged onto the discharge tray 120, the sheets SH are stably discharged and stacked on the support surface 120A of the discharge tray 120.

Effects

In the image reading apparatus 1 according to the embodiment, as illustrated in FIG. 7, when the first stopper 111 is located at the first position, the sheet presser 100 is located at the first limit position. In this state, the space between the contact portion 100A of the sheet presser 100 and the support surface 120A, i.e., a positional relationship between the contact portion 100A of the sheet presser 100 and the support surface 120A is determined such that the sheet presser 100 appropriately presses the sheet SH. That is, the angle $\alpha 1$ within which the sheet presser 100 is pivotable is appropriately determined by adjusting the length of the protrusion of the first stopper 111. With this configuration, the sheet presser 100 is not moved off the sheet SH by being pressed back by the sheet SH being discharged. Accordingly, the sheet presser 100 reliably presses the sheets SH onto the support surface 120A.

In the image reading apparatus 1, in the event of a jam of the conveyed sheet SH near the sheet presser 100, the user changes the position of the supply tray 110 from the third position illustrated in FIGS. 4 and 7 (the first state) to the fourth position illustrated in FIGS. 5 and 8 (the second state). As a result, the supply tray 110 functions as the position change mechanism and the switcher and moves the first stopper 111 upward and rightward from the first position illustrated in FIG. 7 to the second position illustrated in FIGS. 5 and 8. As a result, as illustrated in FIG. 8, the first stopper 111 located at the second position allows the sheet presser 100 to move to a position that is farther from the support surface 120A than the first limit position.

Also, in the state in which the first stopper 111 is located at the second position, the second stopper 131 formed on the right end portion 130C of the upper chute 130 contacts the sheet presser 100 being moved to a position farther from the support surface 120A than the first limit position, and thereby stops the sheet presser 100 at the second limit position. This configuration prevents the sheet presser 100 from moving to a position excessively far from the support surface 120A and accordingly prevents breakage of the sheet presser 100.

In this image reading apparatus 1, the size of the space formed between the sheet presser 100 and the support surface 120A is larger in the case where the first stopper 111 is located at the second position illustrated in FIG. 8 than in the case where the first stopper 111 is located at the first position illustrated in FIG. 7. This construction allows the user to easily insert his or her fingers into the space formed between the sheet presser 100 and the support surface 120A.

Accordingly, the sheet SH being discharged is reliably pressed by the sheet presser 100 onto the support surface 120A. Furthermore, the user easily removes the sheet SH jammed near the sheet presser 100.

In the image reading apparatus 1, in the case where the sheet SH being discharged is jammed near the sheet presser 100, the user changes the position of the supply tray 110 from the third position illustrated in FIGS. 4 and 7 (the first state) to the fourth position illustrated in FIGS. 5 and 8 (the second state), so that the supply tray 110 is moved to a position farther from the support surface 120A than the third position (the first state). This construction prevents the supply tray 110 from interfering with the user inserting his or her fingers into the space formed between the sheet presser 100 and the support surface 120A.

As illustrated in FIGS. 7 and 8, the angle β2 between the support surface 120A and the supply tray 110 in the state in which the supply tray 110 is located at the fourth position (the second state) is greater than the angle β1 between the support surface 120A and the supply tray 110 in the state in which the supply tray 110 is located at the third position (the first state). Thus, as illustrated in FIGS. 5 and 8, when the user causes the supply tray 110 to pivot about the pivot axis X110 to the fourth position (the second state), a space is formed over the sheet presser 100, allowing the user to easily insert his or her fingers into the space formed between the sheet presser 100 and the support surface 120A.

When the user inserts his or her fingers into the space formed between the sheet presser 100 and the support surface 120A, the user only needs to cause the supply tray 110 to pivot to the fourth position (the second state) to change the position of the first stopper 111 from the first position illustrated in FIG. 7 to the second position illustrated in FIG. 8. Also, the user only needs to change the position of the supply tray 110 back to the third position (the first state) after removal of the jammed sheet SH, to change the position of the first stopper 111 back to the first position illustrated in FIG. 7. This construction simplifies an operation of the user for removing the jammed sheet SH, resulting in reduced manufacturing cost when compared with a construction in which a position change mechanism or a switcher is provided independently of the supply tray 110.

As illustrated in, e.g., FIG. 7, the first ribs 112 formed on the facing surface 110B of the supply tray 110 guide the upper surface of the sheet SH being discharged onto the discharge tray 120. With this construction, even if the sheet SH is curled upward by pressing of the sheet presser 100 such that the curled portion of the sheet SH move away from the support surface 120A, the first ribs 112 guide the sheet SH while preventing the sheet SH from further moving away from the support surface 120A. When the position of the supply tray 110 is changed to the fourth position illustrated in FIGS. 5 and 8 (the second state), the first ribs 112 are also moved away from the support surface 120A. This construction prevents the first ribs 112 from interfering with the user inserting his or her fingers into the space formed between the sheet presser 100 and the support surface 120A.

As illustrated in, e.g., FIG. 7, the second stopper 131 is molded integrally with the upper chute 130, resulting in reduction in the number of components.

As illustrated in FIG. 9, the protrusion 121 raises the central portion of the sheet SH being discharged onto the support surface 120A to curve the sheet SH, thereby making the sheet SH more strong. In this operation, the four second ribs 122 supplementally raise the sheet SH on opposite sides of the protrusion 121 in the front and rear direction, that is, in the widthwise direction of the sheet SH which is perpendicular to the discharge direction D1. This construction well keeps the curved shape of the sheet SH when compared with the case where the central portion of the sheet SH is raised only by the protrusion 121. In this image reading apparatus 1, accordingly, the sheet SH is made strong well, making it possible to stably discharge the sheet SH onto the discharge tray 120.

As illustrated in, e.g., FIGS. 6 and 7, the protrusion 121 extends to a position located downstream of the second ribs 122 in the discharge direction D1. This construction allows the protrusion 121 to raise the central portion of the sheet SH to keep the curved shape of the sheet SH also after the discharged sheet SH passes through the second ribs 122.

As illustrated in, e.g., FIGS. 6 and 7, the upper edges 122A of the second ribs 122 are curved so as to be closer to the support surface 120A at their downstream portions than at their upstream portions in the discharge direction D1 and so as to be recessed downward. The upper edges 122A having this construction smoothly guide a leading edge portion of the sheet SH being discharged. Also, the leading edge portion of the sheet SH is brought into contact with the support surface 120A at an obtuse angle. Accordingly, it is possible to reduce malfunctions in which the sheet SH being discharged is jammed by colliding with the support surface 120A, the protrusion 121, or the second ribs 122.

While the embodiment has been described above, it is to be understood that the disclosure is not limited to the details of the illustrated embodiment, but may be embodied with various changes and modifications, which may occur to those skilled in the art, without departing from the spirit and scope of the disclosure.

For example, the position of the supply tray 110 is changed from the third position to the fourth position to change the first stopper 111 from the first position to the second position in the above-described embodiment, but the present disclosure is not limited to this construction. For example, the image reading apparatus 1 may be configured such that the pivotal movement of the movable tray is transmitted to the first stopper by, e.g., a linkage mechanism, and thereby the position of the first stopper is changed from the first position to the second position. As another example, the image reading apparatus 1 may be configured such that an operation lever independent of the movable tray is provided, and a position of the operating lever is changed to change the position of the first stopper from the first position to the second position.

The first stopper 111 is the protruding portion protruding from the facing surface 110B in the above-described embodiment, but the present disclosure is not limited to this construction. For example, the first stopper may be a portion of a flat surface as the facing surface 110B and may be mounted on the facing surface of the movable tray independently of the movable tray.

The second stopper 131 is a portion of the flat surface of the upper chute 130 in the above-described embodiment, but the present disclosure is not limited to this construction. For example, the second stopper may be a protrusion which protrudes downward from the upper chute.

The present disclosure may be applied to image reading apparatuses or multi-function peripherals.

What is claimed is:

1. A sheet conveying apparatus, comprising:

a conveyor configured to convey a sheet along a conveyance path in a sheet conveying direction;

a discharge tray configured to support the sheet discharged from the conveyance path;

a sheet presser pivotable about a pivot axis toward and away from a support surface of the discharge tray and configured to be urged by an urging member so as to press the sheet being discharged, onto the support surface;

a first stopper configured to limit a spaced distance between the sheet presser and the support surface to a first distance when the first stopper is located at a first position, and configured to allow the spaced distance to become greater than the first distance when the first stopper is located at a second position; and a position change mechanism configured to change a position of the first stopper between the first position and the second position, wherein the sheet presser is configured to be pivoted to come into contact with the first stopper located at the first position, wherein a downstream portion of the sheet presser in the sheet conveying direction contacts a lower end of the first stopper located at the first position, and wherein the first stopper is configured to stop further pivotal movement of the sheet presser in a state in which the sheet presser is in contact with the first stopper located at the first position, and wherein the sheet conveying apparatus further comprises a second stopper configured to limit the spaced distance to a second distance when the first stopper is located at the second position, and the second distance is greater than the first distance.

2. The sheet conveying apparatus according to claim 1, wherein the first stopper is configured to contact the sheet presser to limit the spaced distance to the first distance when located at the first position, and wherein the first stopper is configured not to contact the sheet presser when located at the second position.

3. The sheet conveying apparatus according to claim 1, wherein the position change mechanism comprises a movable tray, wherein the first stopper is located at the first position when the movable tray is located at a third position, and wherein the first stopper is located at the second position when the movable tray is located at a fourth position which is farther from the support surface than the third position.

4. The sheet conveying apparatus according to claim 3, wherein the movable tray is located above the support surface.

5. The sheet conveying apparatus according to claim 3, wherein the first stopper is provided on a facing surface of the movable tray, and the facing surface faces the sheet presser when the movable tray is located at the third position.

6. The sheet conveying apparatus according to claim 3, wherein the sheet presser comprises a contact portion that becomes closest to the support surface among the sheet presser, wherein the movable tray is supported pivotably about a pivot axis located upstream of the contact portion in a discharge direction in which the sheet is discharged, wherein the sheet presser is located between the support surface and one of opposite end portions of the movable tray, and the one of the opposite end portions is nearer to the pivot axis than another of the opposite end portions, and wherein an angle between the support surface and the movable tray when the movable tray is located at the fourth position is greater than an angle between the support surface and the movable tray when the movable tray is located at the third position.

7. The sheet conveying apparatus according to claim 5, wherein a first rib is formed on the facing surface of the movable tray at a position located downstream of the sheet presser in the sheet conveying direction when the movable tray is located at the third position, and the first rib is configured to guide an upper surface of the sheet being discharged.

8. The sheet conveying apparatus according to claim 1, wherein the conveyor comprises a chute configured to cover a portion of the conveyance path from above, and wherein the second stopper is formed on the chute.

9. The sheet conveying apparatus according to claim 1, wherein the support surface comprises:

a protrusion located on a central portion of the support surface in a widthwise direction perpendicular to a discharge direction in which the sheet is discharged, the protrusion extending in the discharge direction and protruding upward to a position above the support surface; and at least one second rib each located at a position different from a position of the protrusion in the widthwise direction, the at least one second rib extending in the discharge direction and protruding upward to a position above the support surface.

10. The sheet conveying apparatus according to claim 9, wherein the support surface comprises a plurality of second ribs as the at least one second rib, wherein at least one of the plurality of second ribs is located on one of opposite sides of the protrusion in the widthwise direction, and wherein other of the at least one of the plurality of second ribs is located on another of the opposite sides of the protrusion in the widthwise direction.

11. The sheet conveying apparatus according to claim 9, wherein an upper edge of the at least one second rib is curved so as to be recessed downward and so as to be closer to the support surface at a downstream portion of the upper edge than at an upstream portion of the upper edge in the discharge direction.

12. The sheet conveying apparatus according to claim 11, wherein an upper edge of the protrusion is located above the upper edge of the at least one second rib.

13. The sheet conveying apparatus according to claim 9, wherein the protrusion extends to a position located downstream of the at least one second rib in the discharge direction.

14. The sheet conveying apparatus according to claim 1, further comprising a pair of sheet pressers each as the sheet presser.

* * * * *